United States Patent [19]

Ohtomi

[11] 4,433,755

[45] Feb. 28, 1984

[54] ELEVATOR APPARATUS

[75] Inventor: Sadayuki Ohtomi, Inazawa, Japan

[73] Assignee: Mitsubishi Denki Kabushiki Kaisha, Tokyo, Japan

[21] Appl. No.: 265,677

[22] Filed: May 20, 1981

[30] Foreign Application Priority Data

Jun. 3, 1980 [JP] Japan ..... 55-74489

[51] Int. Cl.[3] ..... B66B 11/04

[52] U.S. Cl. ..... 187/20; 254/275; 74/409

[58] Field of Search ..... 187/20, 21, 23, 17, 187/38, 39, 32, 73, 89; 74/411, 411.5, 409; 254/274, 275; 188/187, 181 R, 83

[56] References Cited

U.S. PATENT DOCUMENTS

| | | | |
|---|---|---|---|
| 575,016 | 1/1897 | Towne | 188/83 |
| 1,847,611 | 3/1932 | Hodgkinson | 74/411 |
| 1,924,320 | 8/1933 | James | 187/39 |
| 2,792,080 | 5/1957 | Dunlop | 187/32 |
| 3,371,735 | 3/1968 | Masera | 74/411.5 |
| 3,548,673 | 12/1970 | Suchocki | 74/409 |
| 3,580,096 | 5/1971 | Scheibel | 74/411.5 |
| 3,641,832 | 2/1972 | Shigeta et al. | 187/20 |

*Primary Examiner*—Joseph J. Rolla
*Assistant Examiner*—Kenneth Noland
*Attorney, Agent, or Firm*—Oblon, Fisher, Spivak, McClelland & Maier

[57] ABSTRACT

An elevator apparatus comprising a reduction gear unit having reduction mechanism of rotary parts of parallel axial gears, an input shaft and an output shaft as main parts; a main rope suspending a car and a counterweight; a traction sheave which is directly connected to said output shaft and on which said main rope is wound; and a traction motor for rotating said input shaft of said reduction gear unit comprises a friction device for imparting pushing force to said rotary parts of said reduction gear unit.

3 Claims, 8 Drawing Figures

ELEVATOR APPARATUS

BACKGROUND OF THE INVENTION

1. Field of the Invention

The present invention relates to an elevator apparatus equipped with elevator traction machine having reduction gear mechanism of parallel axial gears.

2. Description of the Prior Arts

Referring to FIGS. 1 and 2, the conventional elevator traction machine will be illustrated.

In FIGS. 1 and 2, the reference numeral (1) designates a hatchway; (2) designates a machine room placed above the hatchway; (3) designates a reduction gear unit having parallel axial gears such as helical gears as main parts which is fixed on a floor of the machine room and the reduction gear unit comprises a fixed body (3*a*) of a gear box; an input shaft (3*b*) fitted to the fixed body (3*a*), a middle shaft (3*c*) fitted to the fixed body (3*a*) in parallel to the input shaft (3*b*); an output shaft (3*d*) fitted to the fixed body (3*a*) in parallel to the middle shaft (3*c*); a first gear (3*f*) of helical gear mounted on the input shaft (3*b*); a second gear (3*g*) mounted on the middle shaft (3*c*) interlocked to the first gear; a third gear (h) of a helical gear mounted on the middle shaft (3*c*) and a fourth gear (3*i*) mounted on the output shaft (3*d*) interlocked to the third gear as the reduction gear mechanism (3*e*).

The reference numeral (4) designates a traction sheave which is rotatably connected at one end of the output shaft (3*d*) of the reduction gear unit (3); (5) designates a traction motor connected at one end of the input shaft (3*b*) of the reduction gear unit (3); (6) designates a main rope suspending a car (7) and a counterweight (8) at the ends of the rope which is wound on the traction sheave (4) and (9) designates a deflector sheave.

In the elevator apparatus having the above-mentioned structure, the traction sheave (4) is turned through the reduction gear unit (3*e*) by driving the traction motor (5) of the traction machine whereby the car (7) is driven by the main rope (6). The reduction gear unit (3*e*) is formed by parallel axial gears (3*f*) to (3*i*) which impart superior transmission efficiency to the conventional worm gear unit whereby energy can be effectively saved.

However, vibration of the reduction gear unit (3*e*) shown by the curve b of FIG. 3 is caused in acceleration and deceleration of the car (7) shown by the speed curve a of FIG. 3 by backlash of the parallel axial gears (3*f*)–(3*i*) of the reduction gear unit (3*e*) of the traction machine. The vibration is transmitted through the traction sheave (4) and the main rope (6) to the car (3) whereby a passenger feels uneasy.

When an interlocking gap of gears exists when the weight of the car (7) and the weight of the counterweight (8) are balanced, the vibration of the car (7) increases.

SUMMARY OF THE INVENTION

It is an object of the present invention to overcome the disadvantages and to save an energy by using a parallel axial gear unit having superior transmission efficiency to the conventional worm gear unit and to reduce vibration of a car by a friction device imparting pushing force to rotary parts for the reduction gear unit.

The foregoing and other objects of the present invention have been attained by providing an elevator apparatus which comprises a reduction gear unit having reduction mechanism of rotary parts of parallel axial gears, an input shaft and an output shaft; a traction sheave which is directly connected to said output shaft of said reduction gear unit and on which a main rope suspending a car and a counterweight is wound; a traction motor for rotating said input shaft of said reduction gear unit; and a friction device for imparting pushing force to said rotary parts of said reduction gear unit.

DETAILED DESCRIPTION OF THE PREFERRED EMBODIMENTS

Figure 1:
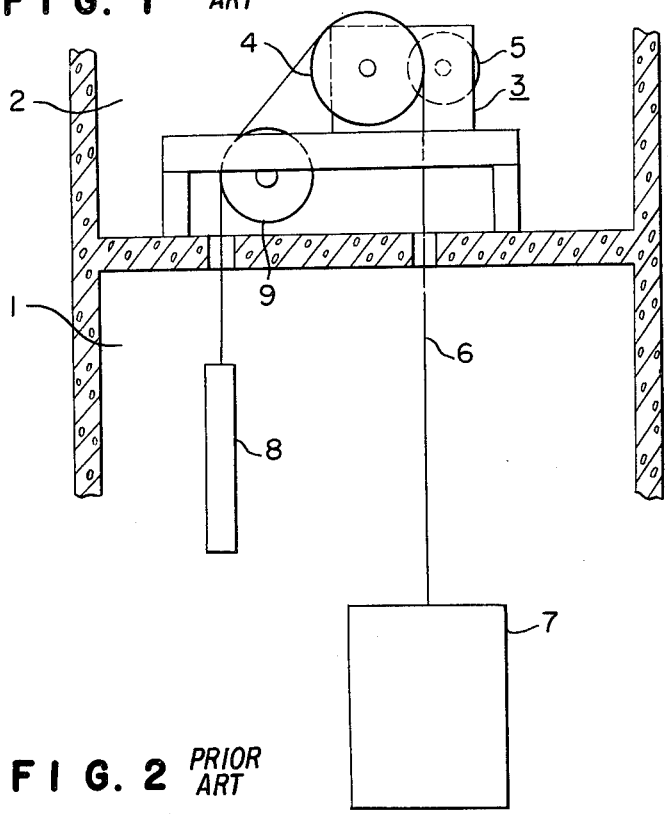
FIG. 1 PRIOR ART
FIG. 1 is a schematic view of an elevator apparatus.
Figure 2:
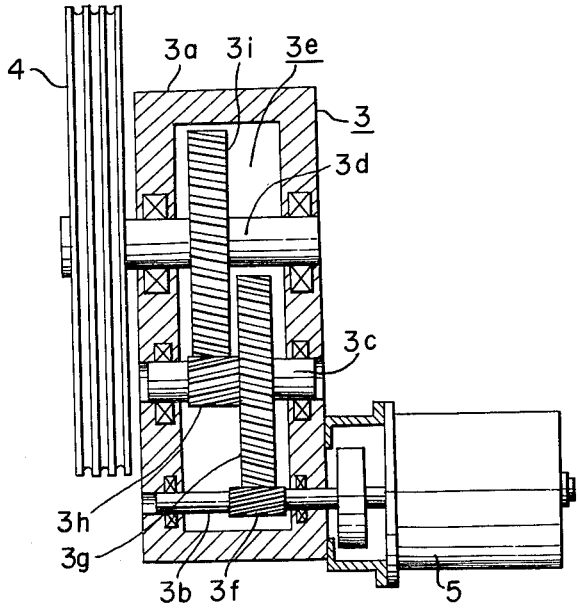
FIG. 2 PRIOR ART
FIG. 2 is a partially sectional plane view of a conventional elevator traction machine.
Figure 3:
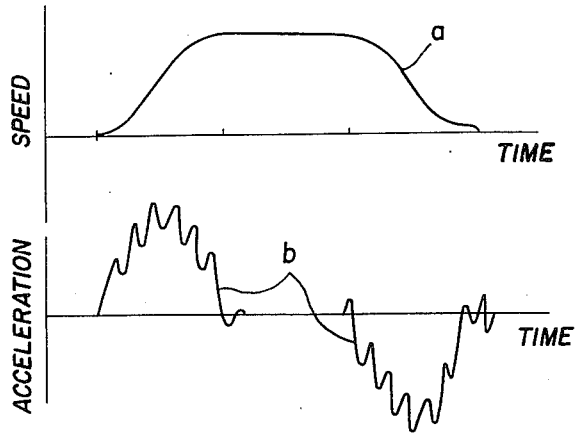
FIG. 3 shows characteristic curves in the operation of the conventional elevator apparatus.
Figure 4:
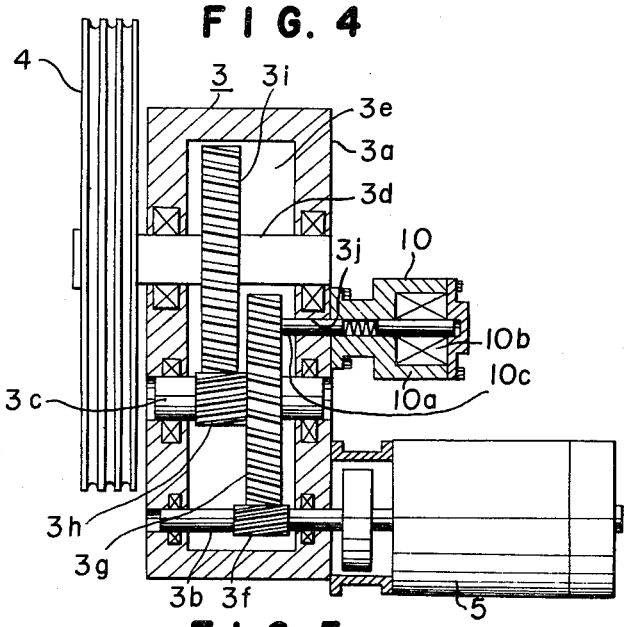
FIG. 4 is a partially sectional plane view of one embodiment of a traction machine of the elevator apparatus of the present invention.
Figure 5:
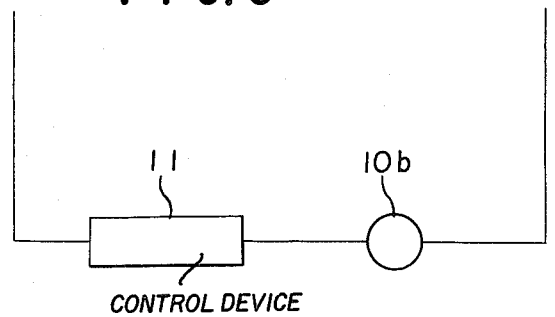
FIG. 5 is a circuit diagram of the important part of the elevator apparatus shown in FIG. 4.

Referring to FIGS. 4 and 5, one embodiment of the present invention will be illustrated. The same references designate identical or corresponding parts shown in FIGS. 1 and 2.

The reference numeral (3*j*) designates a throughhole formed on the fixed body (3*a*) at the position facing the side surface of the second gear (3*g*); (10) designates an electromagnetic friction device for imparting pushing force to the rotary parts of the reduction gear unit (3*e*) and the electromagnetic friction device is placed on the outer surface of the fixed body (3*a*) and comprises a casing (10*a*) holding an electromagnetic coil (10*b*) inside and a friction member (10*c*) comprising two stems having a spring between the stems whose one end is placed to face the side surface of the second gear (3*g*) as one of the rotary parts of the reduction gear unit (3*e*) to be slidably supported in the body (10*a*) through the throughhole (3*j*) and whose other end is projected into the electromagnetic coil (10*b*). The reference numeral (11) designates a control device for generating a command in the state of acceleration or deceleration of the car (3) and the electromagnetic coil (10*b*) of the electromagnetic friction device (10) is actuated by the generation of the command to push the side surface of the second gear (3*g*) by the friction member (10*c*). A power source is shown by (+), (−).

Figure 6:
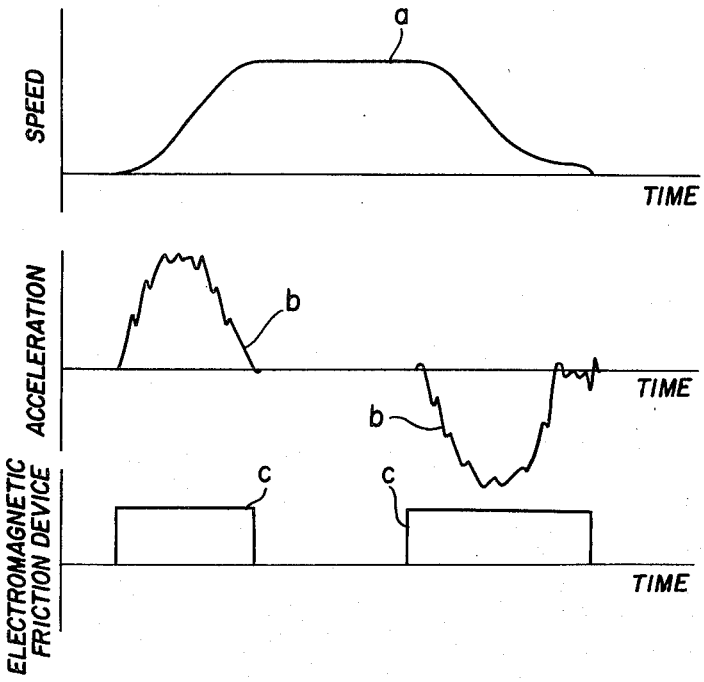
FIG. 6 shows characteristic curves in the operation of the elevator apparatus of the present invention.

In the elevator apparatus having the above-mentioned structure, when the traction motor (5) is driven so as to drive the car (7) as shown by the speed curve a of FIG. 6, the control device (11) generate each command in the state of acceleration and deceleration of the car (7), and the electromagnetic coil (10*b*) of the electromagnetic friction device (10) is actuated as shown by the curve c of FIG. 6 by the circuit of (+)−(11)−(10*b*)−(−) shown in FIG. 5. The friction member (10*c*) is pushed to the second gear (3*g*) by the actuation of the electromagnetic coil (10*b*). Because of the friction, the vibration caused by the backlash of the first to fourth gears (3*f*) to (3*i*) in the acceleration or deceleration of the car (7) is reduced. Thus, the vibration transmitted in the state of the acceleration or deceleration is reduced to give the elevator apparatus a comfortable feeling.

In the state of driving at a constant speed, the command of the control device (7) disappears to extinguish the electromagnetic coil (10*b*) of the electromagnetic friction device (10) and the friction of the second gear (3*g*) by the friction member (10*c*) is eliminated. Thus, the energy loss caused by pushing the second gear (3*g*) can be prevented in the state of driving of the car (7) at a constant speed.

In the above-mentioned embodiment, the control device (11) generates the command during all of the state of the acceleration and deceleration of the car (7). The vibration caused by the backlash of the first to fourth gears (3*f*)–(3*i*) is especially severe just after the starting of the car (7) or at just before the stopping of the car. The energy loss can be further reduced by using the control device (11) which generates the command only for said short periods to actuate the electromagnetic coil (10*b*) of the electromagnetic friction device (10) by the command and to push the side surface of the second gear by the friction member (10).

The vibration caused by the backlash increases at the time when the weight of the car (7) balances the load of the weight of counterweight (8). Therefore, the effect can be attained by using the control device (11) to detect the load of the car (7) to generate the command only when the weight of the counterweight (8) balances the car.

Figure 7:
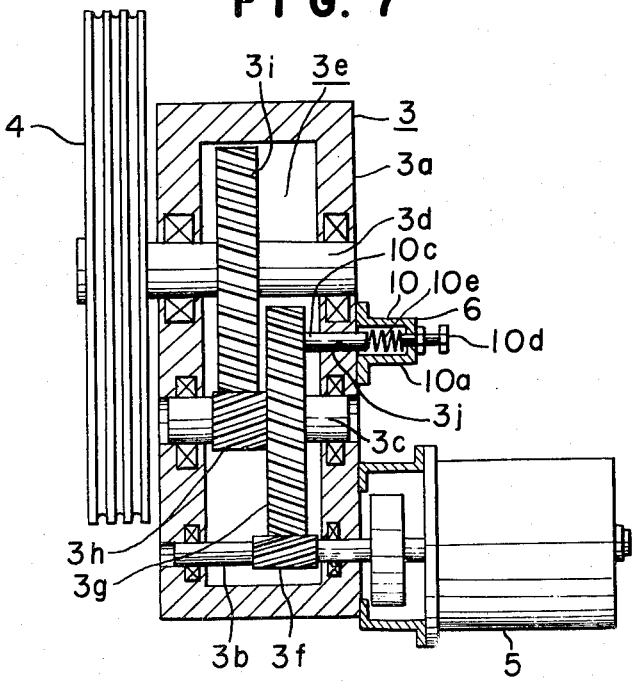
FIGS. 7 and 8 are respective partially sectional plane views of the other embodiments of a traction machine of the elevator apparatus of the present invention.

FIG. 7 shows the other embodiment of the present invention wherein the friction device (10) for imparting friction to the second gear (3*g*), comprises a cylinder (10*a*) having a bottom having a screw hole which covers a throughhole on the surface of the fixed body (3*a*), a polyurethane friction member (10*c*) which is slidably fitted in the hole (3*j*) of the fixed body (3*c*) to contact with a side surface of the second gear (3*g*) at one end and to place in the cylinder (10*a*) at the other end; an adjusting screw (10*d*) screwed into the screw hole of the bottom of the cylinder (10*a*) to project in the cylinder (10*a*); and a pushing element (10*e*) of a compressed coil spring connected to the adjusting screw (10*d*) and the friction member (10*a*).

In the elevator apparatus having the above-mentioned structure, the friction member (10*c*) is held on the fixed body (3*a*) to impart a desired pushing force to the side surface of the second gear (3*g*) by the pushing element (10*e*) adjusted by the adjusting screw (10*d*). Therefore, the vibration caused by the backlash of the rotary parts of the first to fourth gears (3*f*)–(3*i*) which is caused by the vibration of the car (7) etc. is reduced by the friction of the friction member (8) on the side surface of the second gear (3*g*). Thus, the total vibration (pulsation) caused by the backlash of the reduction gear unit (3*e*) can be reduced. The vibration of the car (7) is reduced to give the elevator apparatus comfortable feeling.

In the above-mentioned embodiment, the friction member (10*c*) imparts the pushing force to the second gear (3*g*). The same effect is also attained by imparting the pushing force to one of the other rotary parts of the first, third or fourth gears (3*f*), (3*h*), (3*i*) and the input shaft (3*b*), the middle shaft (3*c*) and the output shaft (3*d*), in the reduction gear unit (3*e*).

Figure 8:
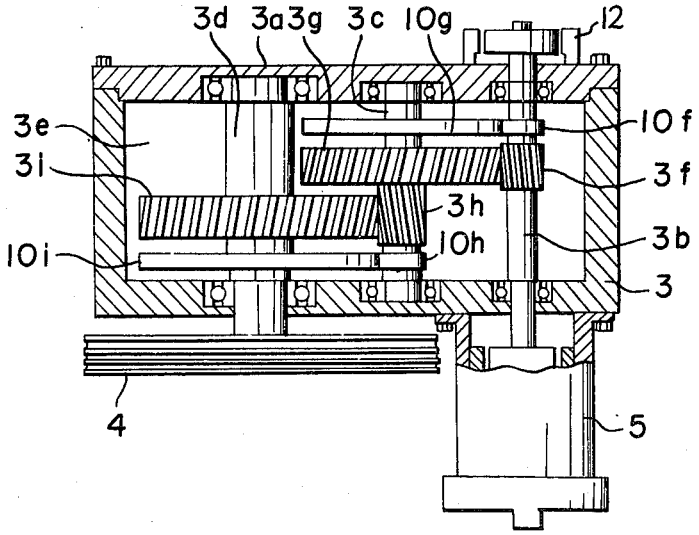

FIG. 8 shows the other embodiment of the present invention the same references designate the identical or corresponding parts shown in FIG. 4. The reference numeral (10*f*) designates a first friction disk made of a metal having an outer diameter corresponding to the pitch circle of the first gear (3*f*), which is fixed to the input shaft (3*b*); (10*g*) designates a second friction disk made of a metal having an outer diameter corresponding to the pitch circle of the second gear (3*g*), which is fixed to the middle shaft (3*c*) and is placed to contact the peripheral part with the peripheral part of the first friction disk (10*f*); (10*h*) designates a third frictional disk made of a metal having an outer diameter corresponding to the pitch circle of the third gear (3*h*), which is fixed to the middle shaft (3*c*) and (10*i*) designates a fourth disk made of a metal having an outer diameter corresponding to the pitch circle of the fourth gear (3*i*), which is fixed to the output shaft (3*d*) and is placed to contact the peripheral part with the peripheral part of the third frictional disk (10*h*). The friction device (10) is formed by the first to fourth friction disks (10*f*) to (10*i*). The reference numeral (12) designates an electromagnetic brake which is connected to the fixed body (3*a*) to brake the input shaft (3*b*).

In the elevator apparatus having the above-mentioned structure, the first to fourth friction disks (10*f*) to (10*i*) are rotated with the first to fourth gears (3*f*) to (3*i*) by the traction motor (5) whereby the first and second friction disks (10*f*), (10*g*) are rotated in contact and the third and fourth friction disks (10*h*), (10*i*) are rotated in contact. Therefore, the collisions of the teeth of the gears of the reduction gear unit (3*e*) interlocking each other are controlled by the friction of the friction disks of the friction device (10) to buffer the collisions of the teeth. Thus, the vibration caused by the backlash of the gears of the reduction gear unit (3*e*) is reduced to reduce the vibration transmitted to the car. Thus, the feeling in the car (7) can be improved.

The same effect is attained by the modification of the embodiment that the first to fourth friction disks (10*f*) to (10*i*) can be fixed on the corresponding side surfaces of the gears (3*f*) to (3*i*) or can be fixed on the corresponding projected ends of the input shaft (3*b*), the middle shaft (3*c*) and the output shaft (3*d*) which are projected out of the reduction gear unit (3).

The same effect is also attained by the modification that the first to fourth friction disks are made of rubber instead of the metal so as to contact with the elastic deformation. Thus, the frictions of the friction disks increase to impart superior effect for reducing the vibration. When the friction disks are made of an elastic material, the noise of the friction disks is advantageously lower than that of a rigid material.

In accordance with the present invention, the elevator apparatus comprises the reduction gear unit having the reduction mechanism of the rotary parts of the parallel axial gears, the input shaft and the output shaft and further comprises the friction device for pushing the rotary parts of the reduction gear unit. Therefore, the energy can be saved by the reduction gear unit of the parallel axial gears which imparts superior transmission efficiency to the conventional reduction gear unit of worm gears and the vibration caused by backlash of the parallel gears is reduced by the friction device to reduce the vibration of the car to give the elevator apparatus a comfortable feeling.

I claim:

1. In an elevator apparatus comprising a reduction gear unit having a reduction mechanism of rotary parts of parallel axial gears, an input shaft and an output shaft as main parts; a main rope suspending a car and a counterweight; a traction sheave which is directly connected to said output shaft and on which said main rope is wound; and a traction motor for rotating said input shaft of said reduction gear unit, an improvement comprising a friction device for imparting pushing force to said rotary parts of said reduction gear unit;

wherein said friction device comprises a body which is fitted on the outer surface of said reduction gear unit and which holds an electromagnetic coil inside;

a friction member whose one end is placed to face the side surface of said rotary parts of said reduction gear unit and whose other end is inserted in said electromagnetic coil;

wherein said improvement further comprises control means for actuating said electromagnetic coil for pushing said friction member into contact with said rotary parts each time that said traction motor accelerates or decelerates said car, wherein said electromagnetic coil is actuated by balancing a weight of said car and a load to a weight of said counterweight whereby said friction member imparts pushing force to said rotary parts of said reduction gear unit.

2. The elevator apparatus according to claim 1 wherein said electromagnetic coil is actuated at just after starting or at just before stopping of said car whereby said friction member imparts pushing force to said rotary parts of said reduction gear unit.

3. In an elevator apparatus comprising a reduction gear unit having a reduction mechanism of rotary parts of parallel axial gears, an input shaft and an output shaft as main parts; a main rope suspending a car and a counterweight; a traction sheave which is directly connected to said output shaft and on which said main rope is wound; and a traction motor for rotating said input shaft of said reduction gear unit, an improvement comprising a friction device for imparting pushing force to said rotary parts of said reduction gear unit;

wherein said friction device comprises a body which is fitted on the outer surface of said reduction gear unit and which holds an electromagnetic coil inside;

a friction member whose one end is placed to face the side surface of said rotary parts of said reduction gear unit and whose other end is inserted in said electromagnetic coil;

wherein said improvement further comprises control means for detecting a balance of the weight of said car and said counterweight, and for actuating said electromagnetic coil when said balance is detected.

* * * * *